US006553732B2

(12) United States Patent
Shaw

(10) Patent No.: US 6,553,732 B2
(45) Date of Patent: Apr. 29, 2003

(54) ORNAMENTED CORNER POST

(75) Inventor: Robert David Shaw, Parma, MI (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 09/934,413

(22) Filed: Aug. 21, 2001

(65) Prior Publication Data

US 2003/0037495 A1 Feb. 27, 2003

(51) Int. Cl.[7] ..... E04B 2/00; E04C 2/38; E04C 3/00; E04D 1/36

(52) U.S. Cl. ..... 52/287.1; 52/288.1; 52/465; 52/716.1; 52/718.04

(58) Field of Search ..... 52/288.1, 287.1, 52/255, 257, 417, 276, 716.1, 726.1, 312, 272, 718.05, 718.04, 254, 489, 717.01, 718.02, 717.03, 713.05, 280, 718.01, 732, 465

(56) References Cited

U.S. PATENT DOCUMENTS

| | | | | | |
|---|---|---|---|---|---|
| 960,677 | A | * | 6/1910 | McGann | 312/140 |
| D60,733 | S | | 3/1922 | Murnane, Jr. | |
| 1,688,134 | A | * | 10/1928 | Braunstein | 52/244 |
| 2,138,470 | A | * | 11/1938 | Bischoff | 52/242 |
| 2,297,887 | A | * | 10/1942 | Hall | 220/DIG. 3 |
| 3,825,229 | A | * | 7/1974 | Bartlett et al. | 248/251 |
| 4,083,215 | A | | 4/1978 | Guetzlaff | |
| 4,162,567 | A | | 7/1979 | Guetzlaff | |
| 4,189,885 | A | * | 2/1980 | Fritz | 52/278 |
| 4,532,739 | A | * | 8/1985 | Cooper | 52/465 |
| 4,709,525 | A | * | 12/1987 | Adell | 293/128 |
| 4,833,853 | A | * | 5/1989 | Deibele et al. | 52/410 |
| 4,838,004 | A | * | 6/1989 | Adell | 293/128 |
| 5,165,643 | A | * | 11/1992 | Shreiner | 248/251 |
| 5,347,784 | A | | 9/1994 | Crick et al. | |

(List continued on next page.)

FOREIGN PATENT DOCUMENTS

| | | | | |
|---|---|---|---|---|
| BE | 563755 B | * | 6/1960 | 52/287.1 |
| FR | 909537 A | * | 5/1946 | 52/288.1 |
| JP | 402016260 | * | 1/1990 | |
| JP | 404277254 | * | 10/1992 | |
| WO | WO 91/02868 | * | 3/1991 | |

OTHER PUBLICATIONS

1995 Sweet's General Building & Renovation, pp. 26–27. Acrovyn ® Standard Flush Corner Guards, model #s FS–10/20 and SFS–10/20.*

Acrovyn ® website: www.cityplastics.com.au/corners.html.*

Boston Trim ™ System articel: "Trim That's A Snap" Store Equipment & Design, No. 7, vol. 9, p. 16; ISSN: 1077–243X; Jul. 1, 2000.*

Boston Trim ™ System website: www.bostonretail.com/décor/wallspecs.html.*

*Primary Examiner*—Carl D. Friedman
*Assistant Examiner*—Kevin McDermott
(74) *Attorney, Agent, or Firm*—Duane Morris LLP

(57) ABSTRACT

A corner piece for covering a corner of a structure defined by two mating walls of the structure and for use in conjunction with siding panels attached to the mating walls includes an ornamented central portion having a first and second lateral edges and a first and second side walls. Each of the first and second side walls has an exterior face and an interior face. The first and second side walls are integrally formed with the ornamented central portion and extend from the first and second lateral edges, respectively. The first and second side walls cover a portion of the first and second mating walls of the structure, respectively, and overlap at least a portion of the siding panels when the siding panels and the corner piece are fastened to the structure.

23 Claims, 2 Drawing Sheets

U.S. PATENT DOCUMENTS 5,517,794 A * 5/1996 Wagner ..... 403/110
5,542,222 A * 8/1996 Wilson et al. ..... 52/276
5,560,170 A 10/1996 Ganser et al.
5,664,376 A * 9/1997 Wilson et al. ..... 52/287.1
5,813,179 A * 9/1998 Koenig et al. ..... 403/267
5,908,185 A * 6/1999 Collette et al. ..... 248/345.1
5,974,748 A * 11/1999 Sciuga et al. ..... 52/287.1
6,036,156 A * 3/2000 Collette et al. ..... 248/345.1
6,145,203 A 11/2000 Appleman
6,324,806 B1 * 12/2001 Rebman ..... 52/465

* cited by examiner

ORNAMENTED CORNER POST

FIELD OF THE INVENTION

This invention relates to corner posts used in building, housing and other constructions, and more particularly to corner posts that provide an ornamented appearance to finished corners.

BACKGROUND OF THE INVENTION

Corner posts are frequently used to finish the corners on the exteriors of homes and businesses. They can be used to provided subtle details or more pronounced architectural details for a corner while providing an aesthetic cover for the ends of rows of siding panels attached to the walls of the structure. A beaded corner post typically provides the appearance of a beaded center area—an area with a relatively wide face and a rounded center protrusion—flanked by two side faces. Each side face may include, for example, an ornamental impression, such as a woodgrain finish. Each side face may also be fluted, or have a smooth, flat finish. The center area, rather than being beaded, may also include more detailed ornamental impressions and shapes, be cove shaped, and/or be any number of colors. The selected color need not be the same as the color of the siding panels attached to the structure or the side faces of the corner post.

FIG. 1 is an exploded view illustrating a prior art three-piece beaded corner post system 1. A beaded corner insert 2 is attached to a corner 4 of a structure. A first nailing flange 6*a* of corner insert 2 is typically nailed to a first exterior face 8*a* of the corner 4, and a second nailing flange 6*b* is typically nailed to a second exterior face 8*b* of the corner 4. The beaded corner insert 2 includes a central beaded protrusion portion 20 which is rounded. After the beaded corner insert 2 is affixed to the corner 4, mating portion 11 of a first side panel 10 (also referred to as a lineal) is fitted into an area 12*a* defined by the profile of beaded corner insert 2. The side panel 10 is typically nailed to the first exterior face 8*a* through nailing flange 14. The ends of the rows of siding panels (not to be confused with side panel 10) that are attached to the structure terminate near the corner 4 and are disposed within and covered by J-channel 16. The exterior face 18 of side panel 10 may include an ornamental impression as described above. A second side panel (not shown) is installed in a like manner by fitting the second side panel into area 12*b* defined by the profile of beaded corner insert 2 and by nailing the second side panel to exterior face 8*b* of corner 4. The prior art corner system 1 of FIG. 1, therefore, includes three principal pieces—a beaded corner insert, a first side panel, and a second side panel. It should be understood that the exploded view of FIG. 1 illustrates profile views of the components of a prior art beaded corner post system 1 and that each profile typically extends a length sufficient to cover the height of a corner 4 of a structure.

The prior art three-piece beaded corner post system 1 presents several problems. First, installation of the corner post system 1 requires the installation of three separate pieces—a corner insert 2 and two side panels 10. Also, many customers, after some time has passed, wish to replace the beaded portion 20 of the corner system, either because of damage to the beaded portion 20 or for aesthetic reasons, e.g., to replace the beaded portion with a portion having a different aesthetic look and/or a different color. Replacement of the beaded portion 20 of the beaded corner system 1 necessarily requires removal of siding panels fitted within J-channel 16, removal of the first and second side panels 10 attached to the corner 4, and removal of beaded corner insert 2, all followed by the complex re-installation of the three-piece beaded corner post system 1 having a replacement beaded corner insert 2.

FIG. 2 is an exploded view illustrating a prior art four-piece beaded corner post system 30. A starter section 36 is attached by a nailing flange 38 to a first exterior face 34*a* of corner 32. A mating portion 41 of first side panel 40 is then fitted into area 42*a* defined by the profile of the starter section 36, and the first side panel 40 is secured to first exterior face 34*a* by nailing flange 44. The ends of the rows of siding panels (not to be confused with side panel 10) that are attached to the exterior face 34*a* of a structure terminate near the corner 32 and are disposed within and covered by J-channel 46 included within side panel 40. The exterior face 48 of side panel 40 may include an ornamental impression as described above in connection with the side panel 10 of FIG. 1. A second side panel (not shown) is installed in a like manner by fitting a mating portion of the second side panel into area 42*b* defined by the profile of the starter 36 and by nailing the second side panel to exterior face 34*b* of corner 32. After the starter 36 and two side panels 40 are installed, a beaded corner insert 50 is fitted into areas 42*a* and 42*b* with mating portion 52*a* and 52*b*, respectively. Like beaded corner insert 2, beaded corner insert 50 includes a central beaded protrusion portion 52 which is rounded. The prior art corner system 30 of FIG. 2, therefore, includes four principal pieces—a starter section, a first side panel, a second side panel, and a beaded corner insert. It should be understood that the exploded view of FIG. 2 illustrates profile views of the components of a prior art beaded corner post system 30 and that each profile typically extends a length sufficient to cover the height of a corner 32 of a structure.

Although the prior art four-piece beaded corner post system 30 allows for easier replacement of the beaded corner insert 50 when compared with three-piece corner post system 1, installation of the four-piece system 30 is even more labor and time intensive than the three-piece beaded corner post system 1; namely, four separate pieces must be installed—a starter section 36, a first and second side panels 46 and a corner insert 50.

Therefore, there is a need for an ornamented corner post system which provides for a simplified installation process. Still further, there remains a need for an ornamented corner post system which allows for easy replacement of or modification of a central ornamented area of the corner post system.

SUMMARY OF THE INVENTION

A corner piece for covering a corner of a structure defined by two mating walls of the structure and for use in conjunction with siding panels attached to the mating walls includes an ornamented central portion having a first and second lateral edges and a first and second side walls. Each of the first and second side walls has an exterior face and an interior face. The first and second side walls are integrally formed with the ornamented central portion and extend from the first and second lateral edges, respectively. The first and second side walls cover a portion of the first and second mating walls of the structure, respectively, and overlap at least a portion of the siding panels when the siding panels and the corner piece are fastened to the structure. The corner piece provides for greatly simplified installation.

Also as described herein, a corner piece includes an ornamented central portion having a first and second lateral edges and a first and second side walls. The ornamented central portion is configured to receive a frictionally fitted ornamented cap. Each of the first and second side walls has an exterior face and an interior face. The first and second side walls are integrally formed with the ornamented central portion and extend from the first and second lateral edges, respectively. The first and second side walls cover a portion of the first and second mating walls of the structure, respectively, and overlap at least a portion of the siding panels when the siding panels and the corner piece are fastened to the structure. The corner piece, in addition to providing for simplified installation, also provides enhanced modularity by allowing ornamented caps of almost limitless designs to be frictionally fitted, or otherwise fastened, over the ornamented central portion.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention as well as other information pertinent to the disclosure, in which.

DETAILED DESCRIPTION OF THE INVENTION

As used herein, the following terms are defined:

"ornamented central portion" means a central portion of a corner piece which is visually distinguishable from the adjacent areas of the corner piece, such as by having a protruded beaded shape, a concave shape, a convex shape, or other more detailed ornamental shape; the surface can include shapes, such as stars, numbers, chevrons, flowers, gargoyles, or characters, formed into or added into its surface;

"ornamented cap" means a cap which fits over an ornamented central portion of a corner piece and which is visually distinguishable from the adjacent areas of the corner piece, such as by having a protruded beaded shape, a concave shape, a convex shape, or other more detailed ornamental shape; the surface can include shapes, such as stars, numbers, chevrons, flowers, gargoyles, or characters, formed into or added into its surface;

"integrally formed" means connected as to form a single, substantially continuous formed structure, such as by a fusion, adhesion or melt bond;

"frictionally fitted" means secured against separation by means of a physical connection relying at least in part on an interfering connection between two mating surfaces of connected bodies; frictionally fitted includes "snap fitted"; and "snap fitted" means secured against separation by means of a snap fit connection where a mating surface(s), area(s), part(s) or profile of a first body is sized to expand or contract under sufficient force to fit over, into or around a mating surface(s), area(s), part(s) or profile of a second body.

Figure 1:
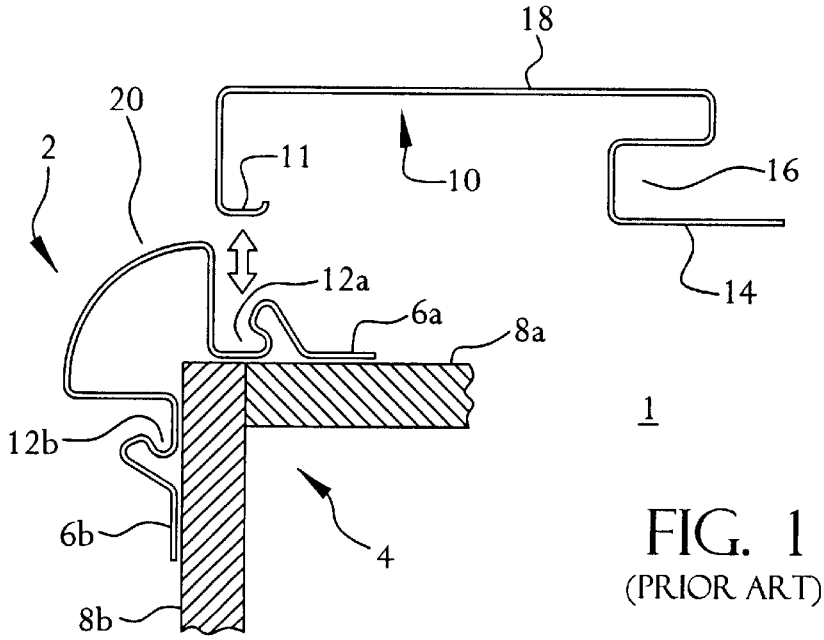
FIG. 1 (PRIOR ART)
FIG. 1 is an exploded profile view of a prior art three-piece beaded corner post system.
Figure 2:
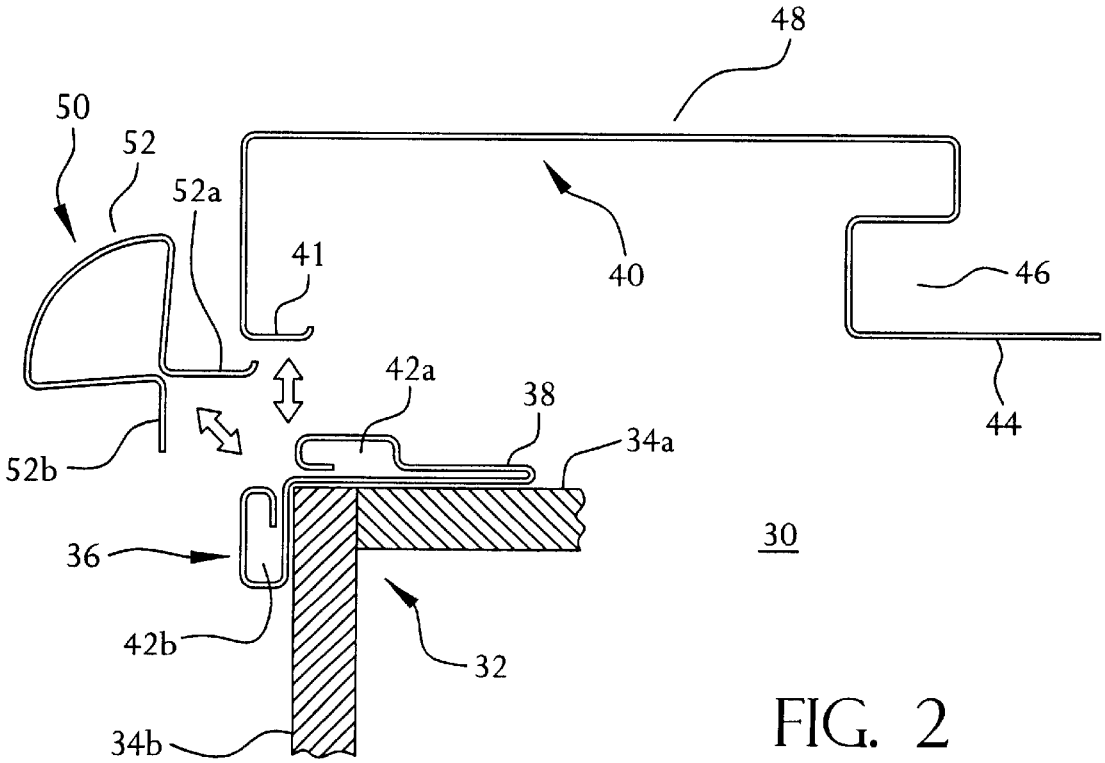
FIG. 2 (PRIOR ART)
FIG. 2 is an exploded profile view of a prior art four-piece beaded corner post system.
Figure 3B:
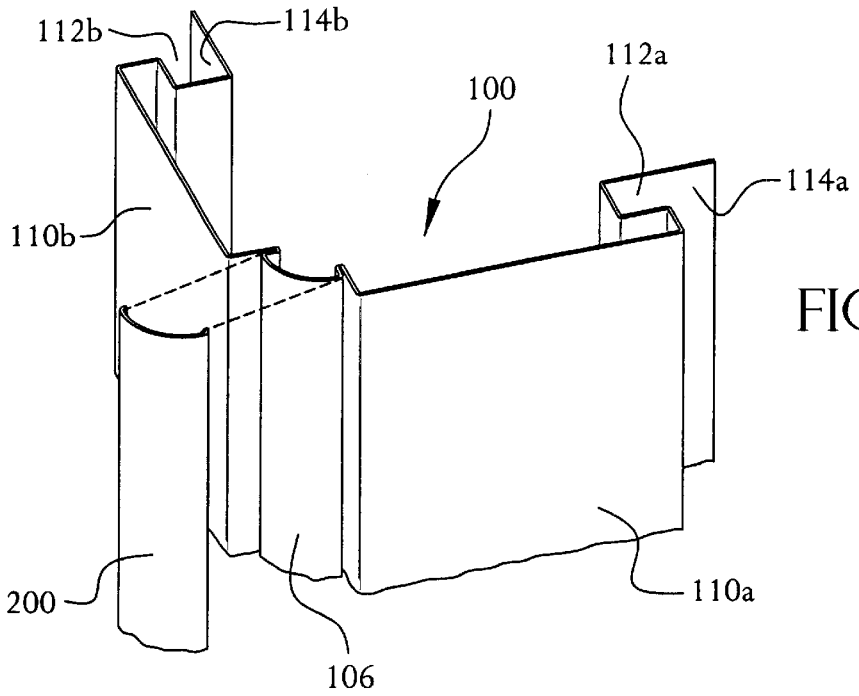
FIG. 3B is an exploded front perspective view of the corner piece of FIGS. 3 and 3A and an ornamented cap according to the present invention.
Figure 3:
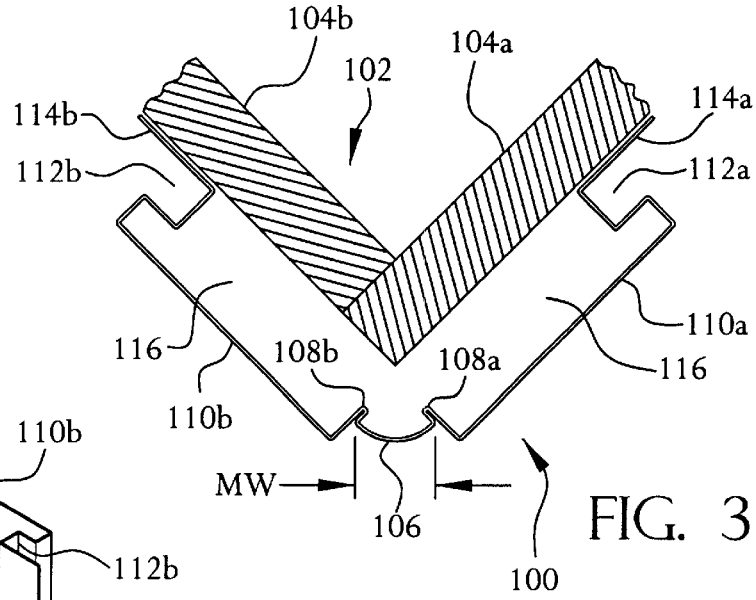
FIG. 3 is a profile view of a corner piece according to the present invention shown affixed to a corner of a structure.
Figure 3A:
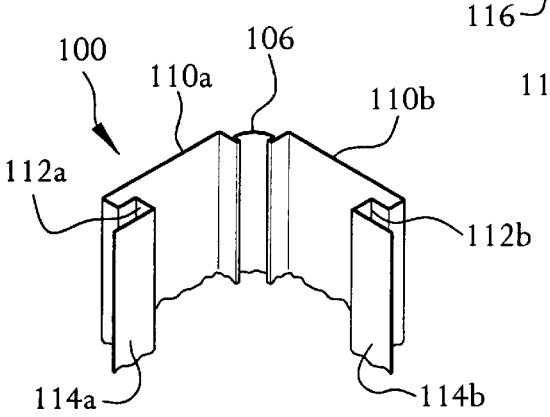
FIG. 3A is a rear perspective view of the corner piece of FIG. 3.

Referring to FIG. 3, a profile view of an ornamented corner piece 100 is shown attached to a corner 102 of a structure, such as a house or building. Corner 102 is defined by a first and second mating walls 104*a*, 104*b* shown in partial. The corner piece 100 is also shown in a front perspective view in FIG. 3B and in a rear perspective view in FIG. 3A.

The corner piece 100 includes an ornamented central portion, such as beaded protrusion portion 106, having a first and second lateral edges 108*a*, 108*b*. The corner piece 100 also includes a first and second side walls 110*a*, 110*b* integrally formed with the beaded protrusion portion 106 and extending from the first and second lateral edges 108*a*, 108*b*, respectively. Each side wall 110*a*, 110*b* has an inside face that faces an exterior face of the corner 104 and an exterior face opposite the interior face. The exterior face of a side wall 110*a*, 110*b* may include, for example, an ornamental impression, such as a woodgrain finish, be fluted, or have a smooth, flat finish.

The first and second side walls 110*a*, 110*b* preferably each cover a portion of the first and second mating walls 104*a*, 104*b*, respectively, and overlap at least a portion of the siding panels (not shown) when the siding panels and the corner piece are fastened to the structure. Each side wall 110*a*, 110*b* of an exemplary corner piece 100 preferably includes a channel, such as a J-channel 112*a*, 112*b*, integrally formed with the side wall 110*a*, 110*b* and disposed to accept and cover the edges of rows of siding panels attached to a wall 104*a*, 104*b* of a structure. The J-channels 112*a*, 112*b* are preferably sufficiently deep to cover the edges during temperature induced expansion and contraction of the siding panels. Each side wall 110*a*, 110*b* also preferably includes a nailing flange 114*a*, 114*b*, integrally formed therewith for securing the corner piece 100 to the corner 102, such as with an adhesive, nails, bolts, or other fastening means or combination thereof.

Figure 3C:
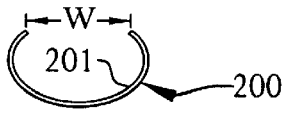
FIG. 3C is is a profile view of the ornamented cap shown in FIG. 3B.

In one embodiment, the corner piece 100 is configured to receive a frictionally fitted ornamented cap, such as beaded cap 200, shown in the exploded perspective view of FIG. 3B and in a profile view in FIG. 3C. The ornamented cap is preferably configured to snap-fit over the ornamented central portion, such as beaded protrusion portion 106. For example, a beaded cap 200 can include an opening of a width W that is smaller than the maximum width MW of the beaded protrusion portion 106, thereby securing the beaded cap 200 over the beaded protrusion portion 106 by a snap-fit connection when the beaded cap 200 expands to fit over the beaded protrusion portion 106. The ornamented cap, as shown in FIG. 3C, may have a first surface 201 that substantially conforms to the shape of the ornamented central portion of the corner piece 100, but this is by no means a requirement.

A structural insert, or plurality of structural inserts (not shown), may be installed between the corner 102 and the corner piece 100 in open areas 116. In one embodiment, the structural inserts include a foam, such as a foam including expanded polystyrene (EPS), polypropylene, polyurethane, polyvinyl chloride (PVC), or other higher modulus polymers or composites. The foam inserts may, for example, be affixed with an adhesive to the interior surfaces of side walls 110*a*, 110*b* or be sized to form an interference or friction fit within open areas 116. The foam insert provides additional structural stability to the corner piece 100, allows corner piece 100 to be relatively thin, and provides for greater leeway in material selection for the corner piece 100.

It should be apparent that the corner piece 100 of the present invention provides for a greatly simplified installation process, i.e., only a single corner piece need be installed to achieve an ornamented corner post appearance, as opposed to installing three or even four pieces as required with prior art corner post systems. Further, while the ornamented central portion of the corner piece 100 may be designed and selected according an individual's taste, and therefore can include an almost limitless number of designs, the ability to snap-fit an ornamented cap to an exemplary corner piece 100 allows for the easy modification of the appearance of the corner piece without removal of the corner piece. Home owners or business proprietors can choose a completely new design (when compared with the design of the ornamented central portion that is integral with the corner piece 100), or simply choose a new color for the existing design of the installed corner piece 100. For example, a pyramid shaped ornamented cap may be fitted over a beaded ornamented central portion, if so desired, or a brown beaded cap can be fitted over a tan beaded protrusion portion of the corner piece.

The corner piece 100 and the ornamented cap 200 are may be formed in an extrusion process from PVC (polyvinyl chloride), although other materials, such as polypropylene or a PVC-wood composite may also be utilized. Corner pieces and ornamented caps may also be formed in other continuous and semi-continuous processes, such as vacuum forming and molding processes, such as injection molding, blow molding, or compression molding, or in post-forming or stamping processes. For example, highly detailed ornamented caps, such as caps resembling flowers, which are only a few inches in height may be molded. These caps need not cover the entire ornamented central portion of the corner piece, but rather could be selectively fitted over the ornamented central portion at desired locations along the ornamented central portion.

Although the corner piece and ornamented cap as shown in the FIGS. have been illustrated as a corner piece 100 having a beaded protrusion portion 106 and a beaded cap 200, respectively, this has been for illustrative purposes only. The present invention is in no way limited to the illustrated designs or shapes. Further, it should be understood that the figures are not drawn to scale and that the corner piece 100 (and ornamented cap if desired) should have a length sufficient to cover a corner of a structure—typically between approximately 10'–20' although a plurality of corner pieces 100 (and ornamented caps if desired) of shorter lengths may be utilized together to cover a corner.

Although various embodiments have been illustrated, this is for the purpose of describing, and not limiting, the invention. Various modifications will become apparent to one skilled in the art and are within the scope of this invention described in the attached claims.

I claim:

1. A corner piece for covering a corner of a structure defined by two mating walls of said structure and for use in conjunction with siding panels attached to said mating walls, said corner piece comprising:

a beaded ornamented central portion having a generally arched face defined between a first and second lateral edges; and a first and second side wall, each of said first and second side walls having an exterior face and an interior face, said first and second side walls being integrally formed with said beaded ornamented central portion and extending from said first and second lateral edges, respectively, wherein said corner piece is configured to directly fasten to said structure and said first and second side walls cover a portion of said first and second mating walls of said structure, respectively, and overlap at least a portion of said siding panels when said siding panels and said corner piece are fastened to said structure such that said exterior faces are exposed.

2. The corner piece of claim 1, further comprising at least one channel formed integrally with one of said first and second side walls, said channel disposed to accept an edge of a siding panel attached to said structure.

3. The corner piece of claim 1, further comprising at least one nailing flange integrally formed with one of said first and second side walls.

4. The corner piece of claim 1, further comprising at least one channel integrally formed with one of said first and second side walls, said channel disposed to accept an edge of a siding panel attached to said structure, said at least one channel further comprising a nailing flange extending therefrom for attaching said corner piece to said structure.

5. The corner piece of claim 1, wherein said central portion includes snap fit recesses defined at said first and second lateral edges, whereby an ornamented cap is adapted to be snap fit over said central portion.

6. The corner piece of claim 5, further comprising an ornamented cap snap fit over said ornamented central portion.

7. The corner piece of claim 6, wherein said ornamented cap has a first surface that substantially conforms to said beaded ornamented central portion.

8. The corner piece of claim 6, wherein said ornamented cap is a different color than said ornamented central portion.

9. The corner piece of claim 1, further comprising at least one insert disposed adjacent to said interior face of at least one of said first and second side walls, said insert providing structural stability to said corner piece.

10. The corner piece of claim 9, wherein said at least one insert comprises foam.

11. The corner piece of claim 9, wherein said insert is affixed to said interior face.

12. A corner piece for covering a corner of a structure defined by two mating walls of said structure and for use in conjunction with siding panels attached to said mating walls, said corner piece comprising:

an ornamented central portion having a first and second lateral edges, said ornamented central portion including snap fit recesses defined at said first and second lateral edges, whereby an ornamented cap is adapted to be snap fit over said central portion; and a first and second side wall, each of said first and second side walls having an exterior face and an interior face, said first and second side walls being integrally formed with said ornamented central portion and extending from said first and second lateral edges, respectively, wherein said corner piece is configured to directly fasten to said structure and said first and second side walls cover a portion of said first and second mating walls of said structure, respectively, and overlap at least a portion of said siding panels when said siding panels and said corner piece are fastened to said structure such that said exterior faces are exposed.

13. The corner piece of claim 12, further comprising an ornamented cap snap fit over said ornamented central portion.

14. The corner piece of claim 13, wherein said ornamented central portion has a beaded shape and said ornamented cap has a first surface that substantially conforms to said beaded shape.

15. The corner piece of claim 13, wherein said ornamented cap is a different color than said ornamented central portion.

16. The corner piece of claim 12, further comprising at least one insert disposed adjacent to said interior face of at least one of said first and second side walls, said insert providing structural stability to said corner piece.

17. The corner piece of claim 16, wherein said at least one insert comprises foam.

18. The corner piece of claim 16, wherein said insert is affixed to said interior face.

19. A corner piece for covering a corner of a structure defined by two mating walls of said structure and for use in conjunction with siding panels attached to said mating walls, said corner piece comprising:

a beaded ornamented central portion having a generally arched face defined between a first and second lateral edges, said ornamented central portion including snap fit recesses defined at said first and second lateral edges, whereby an ornamented cap is adapted to be snap fit over said central portion; and a first and second side wall, each of said first and second side walls having an exterior face and an interior face, said first and second side walls being integrally formed with said ornamented central portion and extending from said first and second lateral edges, respectively, each of said side walls including a respective channel integrally formed with said side walls, said respective channel disposed to accept an edge of a siding panel attached to said structure, said respective channel further comprising a nailing flange extending therefrom for attaching said corner piece to said structure, wherein said first and second side walls cover a portion of said first and second mating walls of said structure, respectively, and overlap at least a portion of said siding panels when said siding panels and said corner piece are fastened to said structure such that said exterior faces are exposed.

20. The corner piece of claim 19, further comprising an ornamented cap snap fit over said ornamented central portion.

21. The corner piece of claim 19, further comprising at least one insert disposed adjacent to said interior face of at least one of said first and second side walls, said insert providing structural stability to said corner piece.

22. The corner piece of claim 21, wherein said at least one insert comprises foam and wherein said insert is affixed to said interior face.

23. A corner piece for covering a corner of a structure defined by two mating walls of said structure and for use in conjunction with siding panels attached to said mating walls, said corner piece comprising:

a beaded ornamented central portion having a first and second lateral edges;

a first and second side walls, each of said first and second side walls having an exterior face and an interior face, said first and second side walls being integrally formed with said ornamented central portion and extending from said first and second lateral edges, respectively; and an ornamented cap frictionally fitted over said ornamented central portion, wherein the ornamented cap has an exposed ornamental surface that only partially covers said corner piece, and wherein said first and second side walls cover a portion of said first and second mating walls of said structure, respectively, and overlap at least a portion of said siding panels when said siding panels and said corner piece are fastened to said structure such that said exterior faces are substantially exposed.

* * * * *